US007420358B2

(12) United States Patent
Byeon et al.

(10) Patent No.: US 7,420,358 B2
(45) Date of Patent: Sep. 2, 2008

(54) INTERNAL VOLTAGE GENERATING APPARATUS ADAPTIVE TO TEMPERATURE CHANGE

(75) Inventors: Sang-Jin Byeon, Kyoungki-do (KR); Seok-Cheol Yoon, Kyoungki-do (KR)

(73) Assignee: Hynix Semiconductor, Inc., Kyoungki-Do (KR)

( * ) Notice: Subject to any disclaimer, the term of this patent is extended or adjusted under 35 U.S.C. 154(b) by 384 days.

(21) Appl. No.: 11/319,299

(22) Filed: Dec. 27, 2005

(65) Prior Publication Data

US 2006/0220633 A1 Oct. 5, 2006

(30) Foreign Application Priority Data

Mar. 31, 2005 (KR) ..... 10-2005-0027398

(51) Int. Cl.
*G05F 3/16* (2006.01)
*G05F 1/10* (2006.01)

(52) U.S. Cl. ..... 323/314; 327/540; 323/316

(58) Field of Classification Search ..... 323/312–316; 327/538–543

See application file for complete search history.

(56) References Cited

U.S. PATENT DOCUMENTS 4,875,195 A * 10/1989 Momodomi et al. ... 365/230.08
6,297,624 B1 * 10/2001 Mitsui et al. ..... 323/316
6,501,299 B2 12/2002 Kim et al.
6,667,904 B2 12/2003 Takeuchi et al.
2002/0024380 A1 * 2/2002 Kono ..... 327/541
2005/0104566 A1 5/2005 Kim
2005/0105367 A1 5/2005 Kim et al.
2005/0174164 A1 8/2005 Fuhrmann et al.

FOREIGN PATENT DOCUMENTS

JP 2000-011671 1/2000
KR 1994-0010105 5/1994

* cited by examiner

*Primary Examiner*—Jessica Han
(74) *Attorney, Agent, or Firm*—Blakely, Sokoloff, Taylor & Zafman LLP

(57) ABSTRACT

An internal voltage generating apparatus adaptive to a temperature change includes a reference voltage circuit including a complementary to absolute temperature (CTAT) type transistor and a proportional to absolute temperature (PTAT) type transistor for generating a first to a third initial reference voltage signals. A buffer circuit for buffering a first, a second and a third initial reference voltage signal is included to generate a first, a second, and a third reference voltage signal in response to enable signals. An internal voltage generating circuit is included to generate an internal voltage signal based on the first, the second and the third reference voltage signal by using an inputted power voltage.

15 Claims, 6 Drawing Sheets

INTERNAL VOLTAGE GENERATING APPARATUS ADAPTIVE TO TEMPERATURE CHANGE

FIELD OF THE INVENTION

The present invention relates to an internal voltage generating apparatus and in particular to an internal voltage generating apparatus capable of controlling various responses to a temperature change.

DESCRIPTION OF THE RELATED ART

Generally, a method of generating an internal voltage through converting an external voltage (e.g., a power supply voltage VDD), which is supplied from an external circuit, into a low voltage level and driving current internally consumed during standby and activation operations using the internal voltage has been employed to meet the demands of high-speed operation and low power dissipation required for dynamic random access memory (DRAM) devices. In addition to the aforementioned memory devices, the above method of generating the internal voltage using the external voltage has been applied to other types of semiconductor devices.

The internal voltage is generated through a down-conversion operation with respect to the external voltage or a charge pumping operation.

According to the conventional method, the external voltage is down-converted into a certain level of the internal voltage using a unit gain buffer and an amplifier operating according to a current mirror mode, and the internal voltage is used to drive a necessary amount of current. The internal voltage is used during the standby and activation operations at core and peripheral regions of the DRAM device. Compared with the case of using the external voltage directly, maintaining a certain level of internal voltage at the operation regions of the DRAM device is advantageous on device reliability and power consumption. The internal voltage uses drivers of the DRAM device alone or together depending on an operation state of the DRAM device (i.e., the standby state or the active state) in order to decrease the power consumption.

With reference to FIGS. 1 to 4, one conventional internal voltage generating method is described hereinafter.

FIG. 1 illustrates a block diagram of an internal voltage generating apparatus operating in a down-conversion mode. In more detail, FIG. 1 illustrates the concept of generating an input voltage signal, i.e., the internal voltage signal $V_{int}$. A reference voltage circuit 1 generates a first reference voltage signal $V_{ref_sum0}$ to generate the internal voltage signal $V_{int}$, and an internal voltage generating circuit 3 receives a second reference voltage signal $V_{ref_sum0}$ through a buffer circuit 2 and generates the internal voltage signal $V_{int}$ through a comparison operation and a feedback operation using a current mirroring device and an amplifier. FIG. 2 is a schematic circuit diagram of the conventional reference voltage circuit of FIG. 1. The conventional reference voltage circuit 1 generates a reference voltage signal, e.g., the first reference voltage signal $V_{ref_sum0}$, using a band gap mode or a widlar mode in order to maintain a consistent value of the reference voltage signal with regardless of temperature, processes and voltage changes. The first reference voltage signal $V_{ref_sum0}$ is inputted to the buffer circuit 2 illustrated in FIG. 1 and is used as a reference voltage signal for generating the internal voltage signal $V_{int}$. Herein, detailed description of the reference voltage circuit 1 will be omitted. The first reference voltage signal $V_{ref_sum0}$ generated from the reference voltage circuit 1 uses a certain level of voltage with respect to changes in process, voltage and temperature (PVT) in the course of designing the reference voltage circuit 1.

Generally, a semiconductor temperature sensor uses a base-emitter voltage signal Vbe of a bipolar junction transistor BTJ and generates a voltage using a complementary to absolute temperature (CTAT) type BJT and a proportional to absolute temperature (PTAT) type BJT. The CTAT type BJT exhibits a negative response to temperature, whereas the PTAT type BJT exhibits a positive response to temperature.

FIG. 3 is a schematic circuit diagram of the buffer circuit 2 of FIG. 1. The illustrated buffer circuit 2 is one exemplary conventional buffer circuit. The conventional buffer circuit 2 receives the first reference voltage signal $V_{ref_sum0}$ through gates of a first N-channel metal oxide semiconductor (NMOS) transistor N1 and a second NMOS transistor N3 and generates the second reference voltage signal $V_{ref_sum}$.

In more detail, when the first reference voltage signal $V_{ref_sum0}$ is enabled, the first NMOS transistor N1 and the second NMOS transistor N3 are turned on and operate, which instigates a P-channel metal oxide semiconductor (PMOS) transistor P5 to be turned on and operate. Therefore, as illustrated in FIG. 3, the second reference voltage signal $V_{ref_sum}$ is generated from the external voltage, i.e., the poser supply voltage VDD.

FIG. 4 is a schematic circuit diagram of the internal voltage generating circuit of FIG. 1. Particularly, FIG. 4 illustrates a standby driver that receives the second reference voltage signal $V_{ref_sum}$ outputted from the buffer circuit 2 and generates the internal voltage signal $V_{int}$.

The external voltages, i.e., the power supply voltage VDD and the group voltage VSS, are input values for operating the above driver and the second reference voltage signal $V_{ref_sum}$ generated at the buffer circuit 2 is used to generate the internal voltage signal $V_{int}$. The internal voltage generating circuit 3 outputs the internal voltage signal $V_{int}$.

A test signal $V_{int_off}$ is disabled in a logic low level in a normal operation. If the test signal $V_{int_off}$ is enabled in a logic high level, a first PMOS transistor to a fourth PMOS transistor P1 to P4 are turned on and supply the external power supply voltage VDD to a first to a third nodes L, R and DRV to thereby disable a current mirror operation.

Hence, in the normal operation, since the test signal $V_{int_off}$ is disabled in a logic low level, the current mirror operation is normally carried out and can also perform an operation that drives current by generating the internal voltage signal $V_{int}$ whose level is twice larger than that of the second reference voltage signal $V_{ref_sum}$. However, it should be noted that the second reference voltage signal $V_{ref_sum}$ for generating the internal voltage signal $V_{int}$ should be precedently set up prior to reaching a power-up level.

Hereinafter, operation of the internal voltage generating circuit will be described in detail. When the external voltage goes up to a certain level that allows a normal operation as a power-up signal, which indicates circuit initialization, is enabled, a certain level of current is supplied through the first PMOS transistor P1 and the second PMOS transistor P2. The second reference voltage signal $V_{ref_sum}$ that passed through the buffer circuit 2 is inputted to a gate of a first NMOS transistor N1 and a second NMOS transistor N3, which are subsequently saturated to operate the current mirroring device. Afterwards, a reference internal voltage signal $V_{int_ref}$, which takes the second reference voltage signal $V_{ref_sum}$ as a reference value, is low, current flows out of the first node L, thereby decreasing a voltage level of the first node L. As a result, a higher amount of current is supplied to an output terminal through a fifth transistor to a seventh transistor P5 to P7. This operation continues until the second reference voltage signal $V_{ref_sum}$ equals to the reference internal voltage signal $V_{int_ref}$. If a value of the reference internal voltage signal $V_{int_ref}$ is higher than that of the second reference voltage signal $V_{ref_sum}$, current is supplied to the first node L, increasing a voltage level of the first node L. As a result, an amount of current supplied to the output terminal through the fifth transistor to the seventh transistor P5 to P7 is decreased.

By the above sequential sensing operations of the current mirroring device, the reference internal voltage signal $V_{int_ref}$ has the value identical to that of the second reference voltage signal $V_{ref_sum}$ based on the use of the second reference voltage signal $V_{ref_sum}$. Because of this equalization of the voltage level, PMOS diode dividers P8 and P9 make the output terminal have a voltage level that is twice higher than that of the reference internal voltage signal $V_{int_ref}$.

However, according to the conventional reference voltage generating circuit, when the above driver exhibits a temperature characteristic due to device or process characteristics, there is no known method of compensating the temperature characteristic. Especially, the second reference voltage signal $V_{ref_sum}$ supplied to the gate of the second NMOS transistor N3 is considered the most critical disadvantage. Since the second reference voltage signal $V_{ref_sum}$ has a certain level of voltage with respect to PVT changes, the above driver exhibits a negative or positive temperature characteristic. If the driver has the positive temperature characteristic, the driver has an increased responsiveness at low temperature, which results in high current dissipation, whereas the driver has a decreased responsiveness at high temperature, which decreases the current dissipation. If the driver has the negative temperature characteristic, the driver exhibits the opposite behavior.

The above result is caused by the fact that the gate voltage of the second NMOS transistor N3 is affected by a trade-off relationship between the current dissipation of the driver and the response. When the current is dissipated periodically at the output terminal, a voltage of this node changes even if this node has a certain level of capacitance. Thus, the term, "response" is defined as an ability to restore the changed voltage level into the original one, and the response is important when the current is dissipated. In some cases, the current dissipation related to the response may become a direct cause of failures.

Generally, a method of enhancing the response is to increase a gate voltage of an enabled transistor or increase a size thereof. As a result, an amount of current flowing to the second NMOS transistor N3 may be increased. However, an amount of standby current may be directly increased, establishing the aforementioned trade-off relationship.

SUMMARY OF THE INVENTION

The present invention provides an internal voltage generating apparatus capable of adjusting a temperature characteristic into a desired level.

The present invention also provides an internal voltage generating apparatus capable of improving an operation characteristic of a semiconductor device through appropriately responding to a temperature characteristic and of increasing reliability of the semiconductor device.

In accordance with an aspect of the present invention, an internal voltage generating apparatus of a semiconductor device includes: a complementary to absolute temperature (CTAT) type transistor and a proportional to absolute temperature (PTAT) type transistor for generating a first to a third initial reference voltage signals; a buffer circuit for buffering the first to the third initial reference voltage signals to generate a first to a third reference voltage signals in response to enable signals; and an internal voltage generating circuit for generating an internal voltage signal based on the first to the third reference voltage signals by using an inputted power voltage.

BRIEF DESCRIPTION OF THE DRAWINGS

The above and other objects and features of the present invention will become apparent from the following description of the preferred embodiments given in conjunction with the accompanying drawings, in which.

DETAILED DESCRIPTION OF THE INVENTION

An internal voltage generating apparatus adaptive to a temperature change in accordance with exemplary embodiments of the present invention will be described in detail with reference to the accompanying drawings.

Figure 1:
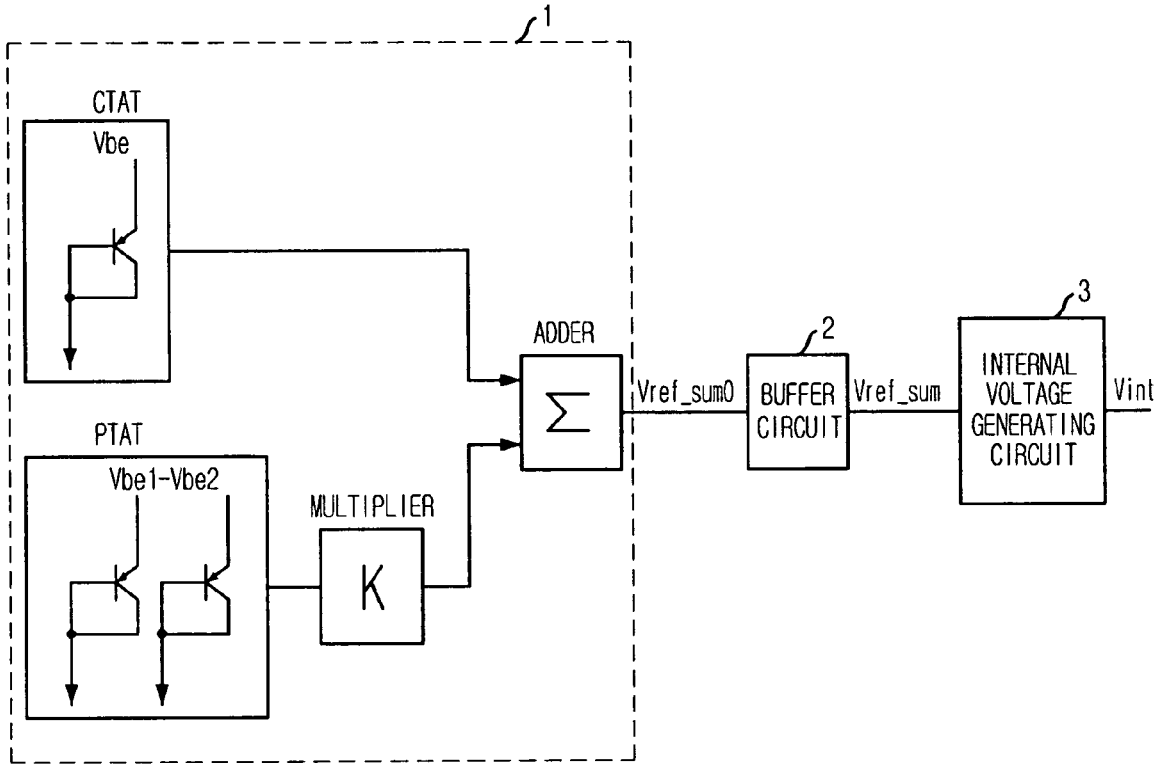
FIG. 1 (PRIOR ART)
FIG. 1 is a block diagram showing a conventional internal voltage generating apparatus operating in a down-conversion mode.
Figure 2:
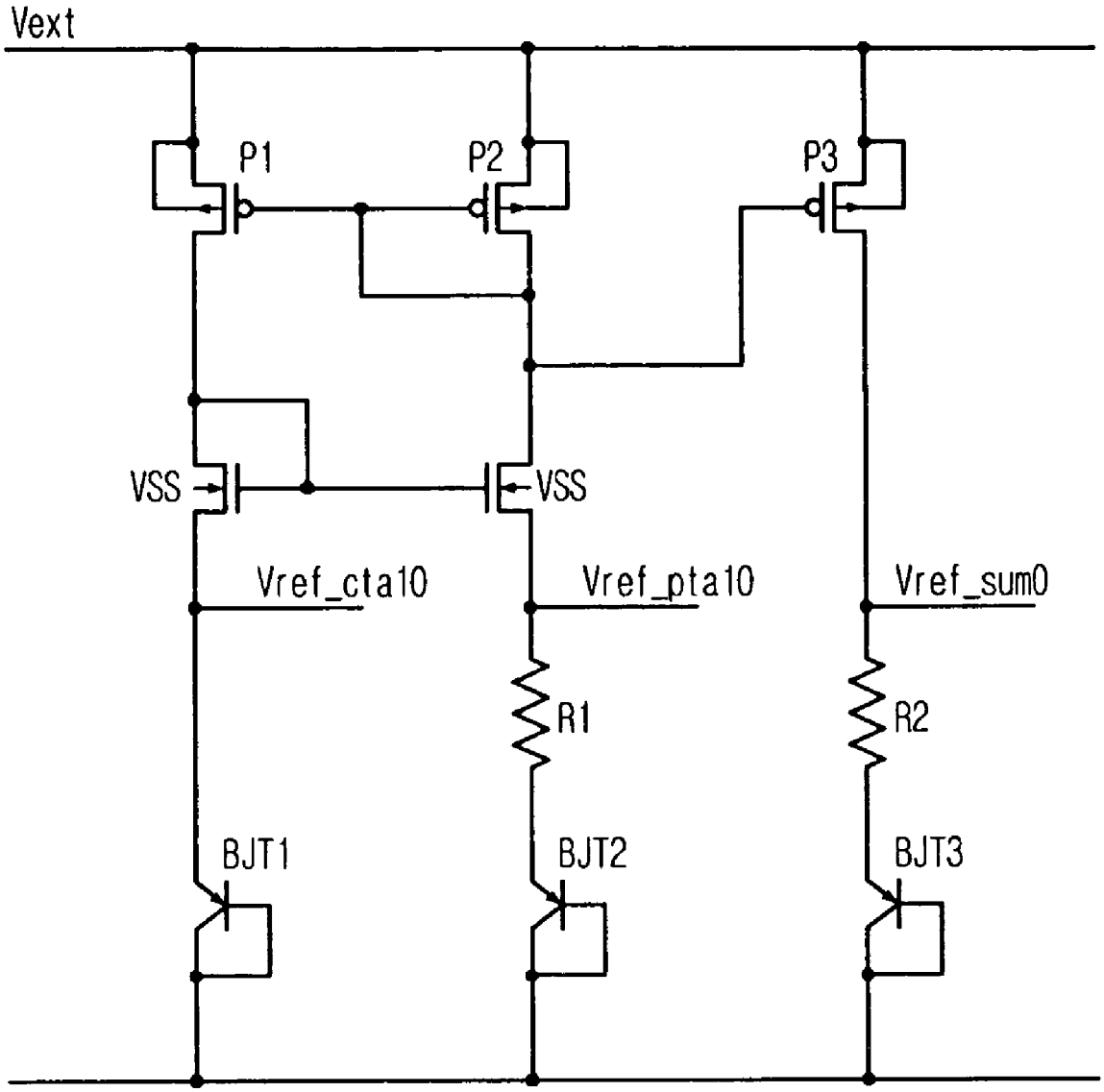
FIG. 2 (PRIOR ART)
FIG. 2 is a schematic circuit diagram describing a reference voltage circuit shown in FIG. 1.
Figure 3:
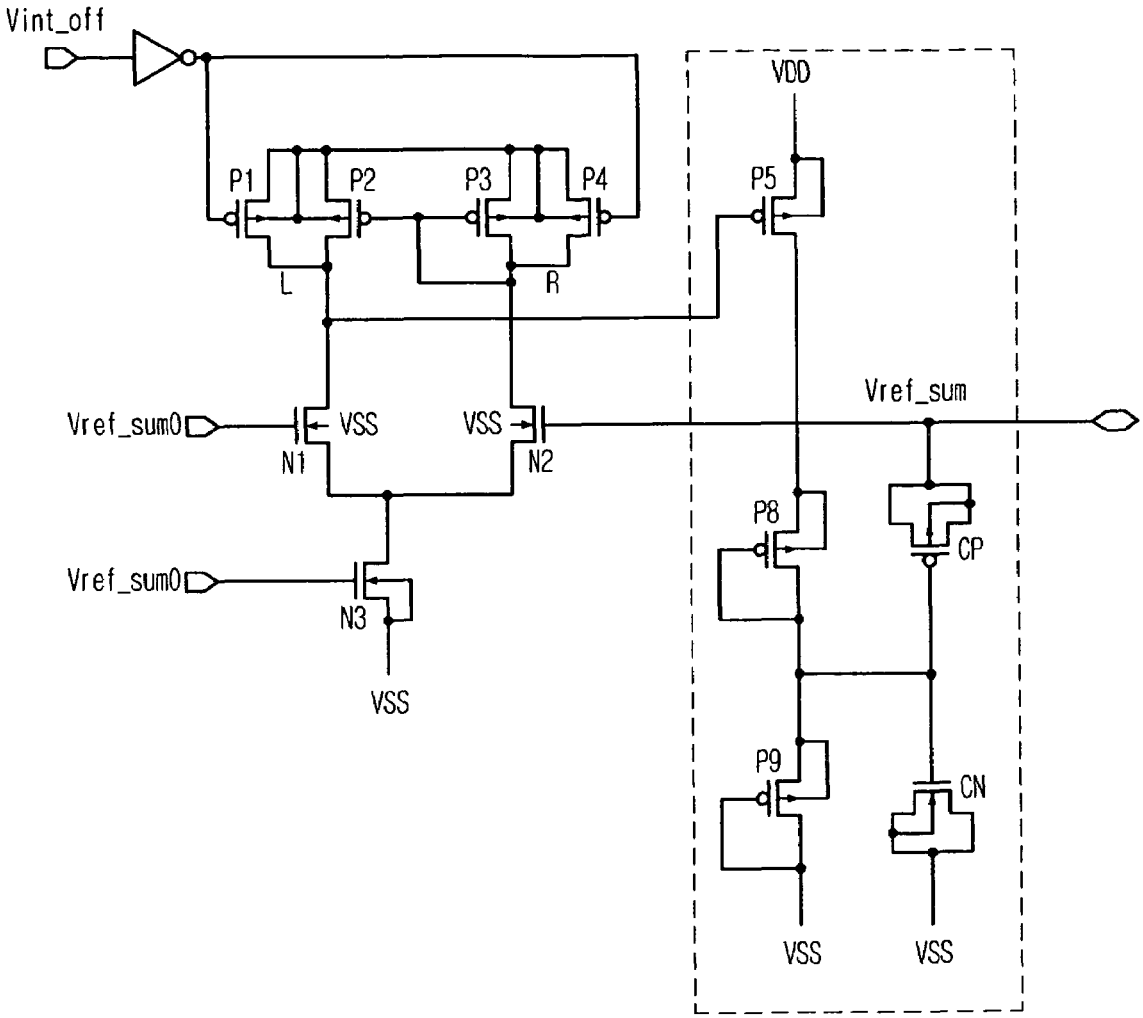
FIG. 3 (PRIOR ART)
FIG. 3 is a schematic circuit diagram depicting a buffer circuit shown in FIG. 1.
Figure 4:
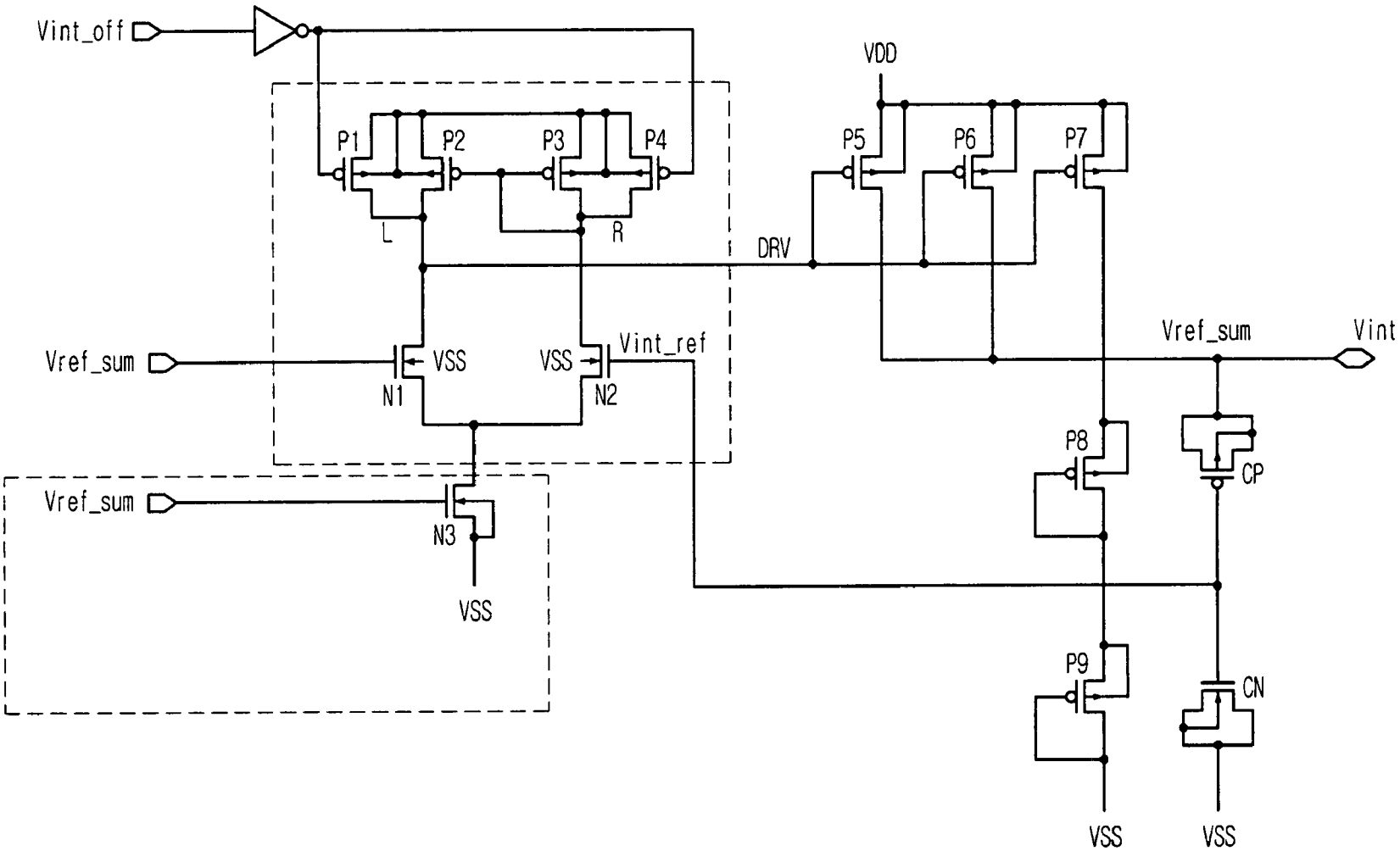
FIG. 4 (PRIOR ART)
FIG. 4 is a schematic circuit diagram describing an internal voltage generating circuit shown in FIG. 1.
Figure 5:
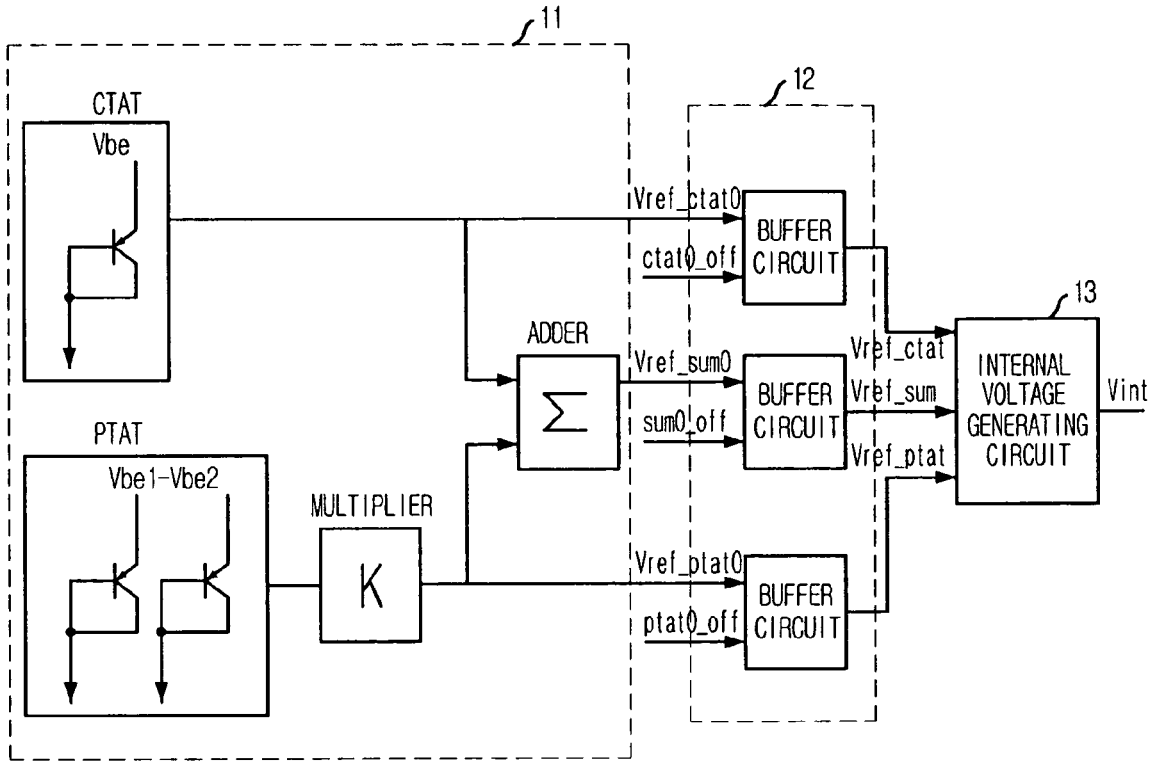
FIG. 5 is a block diagram showing an internal voltage generating apparatus operating in a down-conversion mode in accordance with a specific embodiment of the present invention.

FIG. 5 is a block diagram of an internal voltage generating apparatus operating in a down-conversion mode in accordance with an embodiment of the present invention. Particularly, FIG. 5 illustrates the concept of the internal voltage generating apparatus according to this embodiment of the present invention.

The internal voltage generating apparatus includes a reference voltage circuit 11, a buffer circuit 12, and an internal voltage generating circuit 13.

This embodiment of the present invention is distinctive from the conventional internal voltage generating apparatus in that a first initial reference voltage signal $V_{ref_ctat0}$ outputted from a complementary to absolute temperature (CTAT) bipolar junction transistor (BJT) and a second initial reference voltage signal $V_{ref_ptat0}$ outputted from a proportional to absolute temperature (PTAT) BJT are used in addition to a third initial temperature-independent reference voltage signal $V_{ref_sum0}$, which passed through an adder. Also, a first to a third comparative voltage signals ctat0_off, ptat0_off and sum0_off with respect to the above first to the third reference voltage signals $V_{ref_ctat0}$, $V_{ref_ptat0}$ and $V_{ref_sum0}$ can be additionally used as well.

In more detail, compared with the conventional internal generating apparatus, the internal voltage generating apparatus according to an embodiment of the present invention is configured to adjust a temperature-dependent response characteristic of the internal voltage generating circuit 13 by employing the third initial reference voltage signal $V_{ref_ptat0}$, which exhibits a positive temperature characteristic, and the first initial reference voltage signal $V_{ref_ctat0}$, which exhibits a negative temperature characteristic in addition to the third initial temperature-independent reference voltage signal $V_{ref_sum0}$ which is conventionally employed.

The first to the third comparative voltage signals ctat0_off, ptat0_off and sum0_off determine whether to use the first to the third initial reference voltage signals $V_{ref_ctat0}$, $V_{ref_ptat0}$ and $V_{ref_sum0}$ which are inputted to the buffer circuit 12 and, can be signals inputted from outside or signals generated from a temperature sensing circuit. Also, the first to the third comparative voltage signals ctat0_off, ptat0_off and sum0_off can use a test mode. It is determined which response characteristic should be used with respect to a certain temperature using a specific combination of the first to the third comparative voltage signals ctat0_off, ptat0_off and sum0_off.

The buffer circuit 12 receives the first to the third initial reference voltage signals $V_{ref_ctat0}$, $V_{ref_tat0}$ and $V_{ref_sum0}$ from the reference voltage circuit 11 and generates a CTAT reference voltage signal $V_{ref_ctat}$, a PTAT reference voltage signal $V_{ref_ptat}$ and a temperature-independent reference voltage signal $V_{ref_sum}$, respectively.

The internal voltage generating circuit 13 receives the CTAT reference voltage signal $V_{ref_ctat}$, the PTAT reference voltage signal $V_{ref_ptat}$ and the temperature-independent reference voltage $V_{ref_sum}$ and generates an intended internal voltage signal $V_{int}$ by sequentially going through a comparative operation and a feedback operation using a current mirroring unit and an amplifier.

Figure 6:
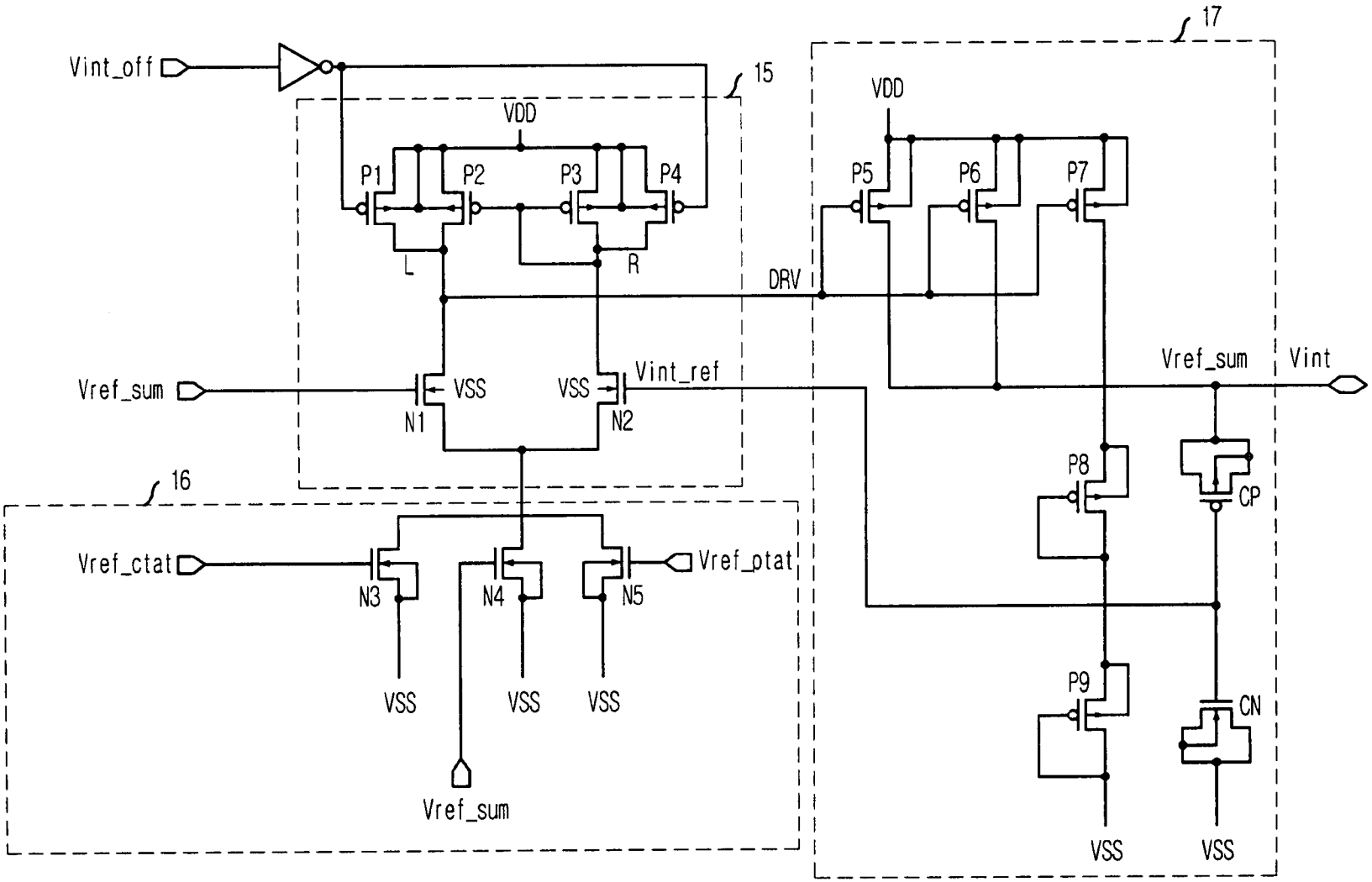
FIG. 6 is a schematic circuit diagram describing an internal voltage generating circuit shown in FIG. 5.

FIG. 6 is a circuit diagram of the internal voltage generating circuit in accordance with an embodiment of the present invention.

The internal voltage generating circuit 13 includes a comparison block 15, an enabling block 16, and an internal voltage output block 17. The comparison block 15 compares the temperature-independent reference voltage signal $V_{ref_sum}$ with a reference internal voltage signal $V_{int_ref}$ and outputs the comparison result. The enabling block 16 enables the comparison block 15 via a combination of the temperature-independent reference voltage signal $V_{ref_sum}$, the CTAT reference voltage signal $V_{ref_ctat}$ and the PTAT reference voltage signal $V_{ref_ptat}$. The internal voltage output block 17 generates an internal voltage signal Vint corresponding to an output value of the comparison block 15 and performs a feedback operation which takes a value corresponding to the internal voltage signal $V_{int}$ as a value of the reference internal voltage signal $V_{int_ref}$.

Compared with the conventional internal voltage generating apparatus which is configured with one N-channel metal oxide semiconductor (NMOS) transistor and generates the internal voltage signal by receiving only the reference voltage signal, which exhibits a temperature-independent characteristic, the enabling block 16 includes three NMOS transistors N3, N4 and N5 and connect the CTAT reference voltage signal Vref_ctat, which exhibits a negative temperature characteristic, the PTAT reference voltage signal $V_{ref_ptat}$, which exhibits a positive temperature characteristic, and the temperature-independent reference voltage signal $V_{ref_sum}$ in parallel with gates of the three NMOS transistors N3, N4 and N5, respectively. The enabling block 16 operates as an enabling means for the comparison block 15, so that a temperature-dependent response characteristic of a driver can be adjusted.

The comparison block 15 includes a differential input unit receiving the temperature-independent reference voltage signal $V_{ref_sum}$ and the reference internal voltage signal $V_{int_ref}$ and compare the received two signals with each other, and the aforementioned current mirroring unit mirroring a current level corresponding to the comparison value outputted from the differential input unit. When one of the three NMOS transistors N3, N4 and N5 of the enabling block 16 is turned on, the comparison block 15 starts its operation, more specifically, the current mirroring unit outputs a current level corresponding to a difference between two NMOS transistors N1 and N2 of the differential input unit.

At this time, a test signal $V_{int_off}$ inputted to the comparison block 15 is disabled in a logic low level in the case of a normal operation, and thus, the test signal $V_{int_off}$ operates the differential input unit and the current mirroring unit normally and generates an internal voltage whose level is twice higher than that of the reference voltage, which performs an operation of driving current.

The internal voltage output block 17 includes a current supply terminal and an impedance terminal. The current supply terminal supplies a certain level of current corresponding to an output value from the comparison block 15. The impedance terminal outputs the internal voltage signal $V_{int}$ in response to the current level outputted from the current supply terminal and performs a feedback operation, which takes a value corresponding to the internal voltage signal $V_{int}$ as a value of the reference internal voltage signal $V_{int_ref}$.

Hereinafter, operation of the internal voltage generating apparatus in accordance with an embodiment of the present invention will be described in detail.

When one of the CTAT reference voltage signal $V_{ref_ctat}$, the temperature-independent reference voltage $V_{ref_sum}$ and the PTAT reference voltage $V_{ref_pat}$, which are supplied to the three transistors N3, N4 and N5 of the enabling block 16 is enabled, the corresponding transistor among the three NMOS transistors N3, N4 and N5 is turned on to operate the comparison block 15.

If a level of the reference internal voltage signal $V_{int_ref}$ is lower than that of the temperature-independent reference voltage signal $V_{ref_sum}$ inputted to a gate of one NMOS transistor N1 of the comparison block 15, current is leaked out of a node L and thus, a voltage level of the node L decreases. As a result, a higher amount of current is supplied to the output terminal through three PMOS transistors P5, P6 and P7 included in the internal voltage output block 17 connected with the node L.

In contrast, when the reference internal voltage signal $V_{int_ref}$ is higher than the temperature-independent reference voltage signal $V_{ref_sum}$ inputted to the gate of the NMOS transistor N1 of the comparison block 15, current is supplied to the node L, thereby increasing a voltage level of the node L and decreasing current supplied to the output terminal through the three PMOS transistors P5, P6 and P7 of the internal voltage output block 17 connected with the node L.

The above operations continue until the temperature-independent reference voltage signal $V_{ref_sum}$ and the reference internal voltage signal $V_{int_ref}$ have the same voltage level. By the above described sequential sensing operations of the current mirroring unit, the reference internal voltage signal $V_{int_ref}$ and the temperature-independent reference voltage signal $V_{ref_sum}$ have the same voltage level and as a result, PMOS diode dividers included in the internal voltage output block 17 increases the above voltage level by approximately 2-fold.

Since a low level of current flows through other diode drivers P8 and P9 of the internal voltage output block 17, it is possible to prevent a discharge event of the output terminal of the internal voltage output block 17. Also, capacitors CP and CN can be used to prevent noise.

In one embodiment of the present invention, an enabling element of a current mirroring unit can be controlled by using the temperature-independent reference voltage signal $V_{ref_sum}$, the CTAT reference voltage $V_{ref_ctat}$ signal and the PTAT reference voltage $V_{ref_ptat}$. Hence, it is possible to adjust a response characteristic of a voltage driver, which varies depending on temperature.

The present application contains subject matter related to the Korean patent application No. KR 2005-0027398, filed in the Korean Patent Office on Mar. 31, 2005, the entire contents of which being incorporated herein by reference.

While the present invention has been described with respect to the particular embodiments, it will be apparent to those skilled in the art that various changes and modifications may be made without departing from the scope of the invention as defined in the following claims.

What is claimed is:

1. An internal voltage generating apparatus of a semiconductor device, comprising:

a reference voltage circuit including a complementary to absolute temperature (CTAT) transistor and a proportional to absolute temperature (PTAT) transistor for generating a first, a second and a third initial reference voltage signal;

a buffer circuit for buffering the first, the second and the third initial reference voltage signal to generate a first, a second and a third reference voltage signal in response to enable signals; and an internal voltage generating circuit for generating an internal voltage signal based on the first, the second and the third reference voltage signal by using an inputted power voltage.

2. The internal voltage generating apparatus of claim 1, wherein the first initial reference voltage signal, the second initial reference voltage signal and the third initial reference voltage signal exhibit a negative temperature characteristic, a temperature-independent characteristic and a positive temperature characteristic, respectively.

3. The internal voltage generating apparatus of claim 1, wherein the first reference voltage signal, the second reference voltage signal and the third reference voltage signal are a CTAT reference voltage signal, a temperature-independent reference voltage signal and a PTAT reference voltage signal, respectively.

4. The internal voltage generating apparatus of claim 1, wherein the buffer circuit includes:

a first buffer block generating the first reference voltage signal when the first initial reference voltage signal is enabled;

a second buffer block generating the second reference voltage signal when the second initial reference voltage signal is enabled; and a third buffer block generating the third reference voltage signal when the third initial reference voltage signal is enabled.

5. The internal voltage generating apparatus of claim 4, wherein the first buffer block, the second buffer block, and the third buffer block operate depending on each enabling state of the enabling signals inputted from an outside.

6. The internal voltage generating apparatus of claim 4, wherein the internal voltage generating circuit includes:

a comparison block comparing the second reference voltage signal with a reference internal voltage signal and outputting the comparison result;

an internal voltage output block generating the internal voltage signal corresponding to an output value of the comparison block and performing a feedback operation which takes a value of the internal voltage signal as a value of the reference internal voltage signal; and an enabling block operating the comparison block by a combination of the first reference voltage signal to the third reference voltage signal.

7. The internal voltage generating apparatus of claim 6, wherein the enabling block includes:

a first transistor receiving the first reference voltage signal through a gate and enabling the comparison block when the first reference voltage signal is inputted;

a second transistor receiving the second reference voltage signal through a gate and enabling the comparison block when the second reference voltage signal is inputted; and a third transistor receiving the third reference voltage signal through a gate and enabling the comparison block when the third reference voltage signal is inputted.

8. The internal voltage generating apparatus of claim 7, wherein the first transistor, the second transistor, and the third transistor are connected in parallel.

9. The internal voltage generating apparatus of claim 8, wherein the first transistor, the second transistor and the third transistor are N-channel metal oxide semiconductor (NMOS) transistors.

10. The internal voltage generating apparatus of claim 7, wherein the comparison block includes:

a differential input unit receiving and comparing the second reference voltage signal and the reference internal voltage signal with each other; and a current mirroring unit mirroring a current level corresponding to a comparison value outputted from the differential input unit.

11. The internal voltage generating apparatus of claim 10, wherein the differential input unit includes NMOS transistors.

12. The internal voltage generating apparatus of claim 11, wherein the current mirroring unit includes PMOS transistors.

13. The internal voltage generating apparatus of claim 10, wherein the internal voltage output block includes:

a current supply terminal supplying a certain level of current corresponding to an output value from the comparison block; and an impedance terminal outputting the internal voltage signal in response to the outputted current from the current supply terminal and performing a feedback operation taking a value corresponding to the internal voltage signal as a value of the reference internal voltage signal.

14. The internal voltage generating apparatus of claim 13, wherein the impedance terminal includes P-channel metal oxide semiconductor (PMOS) diode dividers for generating a voltage whose level is higher than that of the reference internal voltage signal.

15. The internal voltage generating apparatus of claim 13, wherein the internal voltage output block further includes capacitors that operate to prevent noise.

* * * * *